United States Patent [19]

Turner

[11] 4,095,339

[45] Jun. 20, 1978

[54] EGG SLICER

[76] Inventor: Rose Turner, 470 W. 24th St., London Ter. Apts., New York, N.Y. 10011

[21] Appl. No.: 769,665

[22] Filed: Feb. 17, 1977

[51] Int. Cl.[2] ..... B26B 3/00

[52] U.S. Cl. ..... 30/279 R; 30/117; 30/303; 30/304

[58] Field of Search ..... 30/117, 279 R, 304, 30/303, 305, 114

[56] References Cited

U.S. PATENT DOCUMENTS

| | | | |
|---|---|---|---|
| 608,368 | 8/1898 | Lawson | 30/117 UX |
| 634,494 | 10/1899 | Brinser | 30/117 UX |
| 1,424,389 | 8/1922 | Wyatt | 30/304 |
| 1,979,199 | 10/1934 | Haynes | 30/303 X |
| 2,563,237 | 8/1951 | Grocoff | 30/117 X |
| 3,116,770 | 1/1964 | Tanuma | 30/117 X |

FOREIGN PATENT DOCUMENTS

| | | | |
|---|---|---|---|
| 244,555 | 3/1947 | Switzerland | 30/305 |

*Primary Examiner*—Gary L. Smith
*Assistant Examiner*—J.T. Zatarga
*Attorney, Agent, or Firm*—Robert D. Farkas

[57] ABSTRACT

An improved egg slicer is provided which comprises a lower member including a main body having a longitudinal channel therein and an elongated handle issuing from the main body. A cutter means is movably laterally mounted in the main body across a section through the channel therein in a slot provided therefor. The egg to be sliced is mounted in the channel overlying the cutter means. An upper linearly elongated member of the egg slicer has an end pivotally connected to a corresponding end of the lower member thereof. A pusher member registrable in the channel provided in the lower member is journalled in the upper member. The egg overlying the cutter means is forced therethrough by the pusher means as the upper member is pivoted towards the lower member of the slicer.

7 Claims, 5 Drawing Figures

EGG SLICER

BACKGROUND OF THE INVENTION

This invention relates generally to food slicers, and, more particularly to an improved egg slicer.

The homemakers desire for economy of effort and speed has created a market for devices that facilitate the preparation of food, such as slicers, dicers, wedgers and cutters. Many of the slicers heretofore known have employed pushers integrally connected to the cutting edges of the device, or have employed finger guards, or have presupposed that the user would exercise sufficient care to avoid injury during use thereof. The safety precautions of many of these heretofore known devices are deemed unsatisfactory. With the present device, therefore, a remotely actuated pusher is employed to force the comestible through a recessed cutter, thereby holding to the irreducible minimum the possibility of injury to the user.

SUMMARY OF THE INVENTION

Generally speaking, in accordance with the invention, an improved egg slicer is provided which comprises a lower member including a main body having a longitudinal channel therein and an elongated handle issuing from the main body. A cutter means is movably and removably laterally mounted in the main body across a section through the channel therein in a slot provided therefor. The egg to be sliced is mounted in the channel overlying the cutter means.

An upper linearly elongated member of the egg slicer has an end pivotally connected to a corresponding end of the lower member thereof. A pusher member registrable in the channel provided in the lower member is journalled in the upper member.

The egg overlying the cutter means is forced through the cutter means by pivoting the upper member towards the lower member, and correspondingly registering the pusher member in the channel and maintaining the pusher member in abutting forcible engagement against the egg until the egg is forced completely through the cutter means.

Accordingly, it is an object of the invention to provide an improved egg slicer.

Another object of the invention is to provide an improved egg slicer wherein the cutting means is remote from the users hand and fingers.

A further object of the invention is to provide an egg slicer having an unexposed cutting surface.

Still another object of the invention is to provide an egg slicer having movable cutting means for varying the manner of slicing an egg therethrough.

Another object of the invention is to provide an egg slicer having a removable cutting means for exchanging another cutting means therein and for ease of cleaning.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWING

For a fuller understanding of the invention, reference is made to the following description taken in connection with the accompanying drawing, in which.

DETAILED DESCRIPTION OF THE INVENTION

Figure 1:
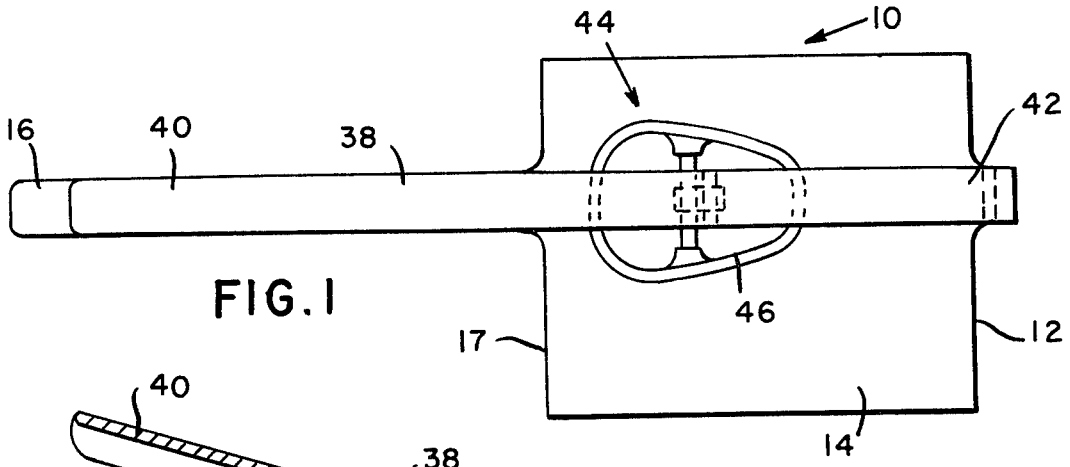
FIG. 1 is a top plan view of the egg slicer constructed according to the instant invention.

Referring now to the drawings, the egg slicer generally numbered 10 includes a lower member 12 comprising a rectangular main body 14 having an elongated handle member 16 issuing laterally from a side 17 thereof and a finger 18 issuing upwardly from an opposite side 19 thereof. An oval shaped longitudinal through channel 20 is provided in the main body 14 and an egg 22 is receivable therein.

Figure 2:
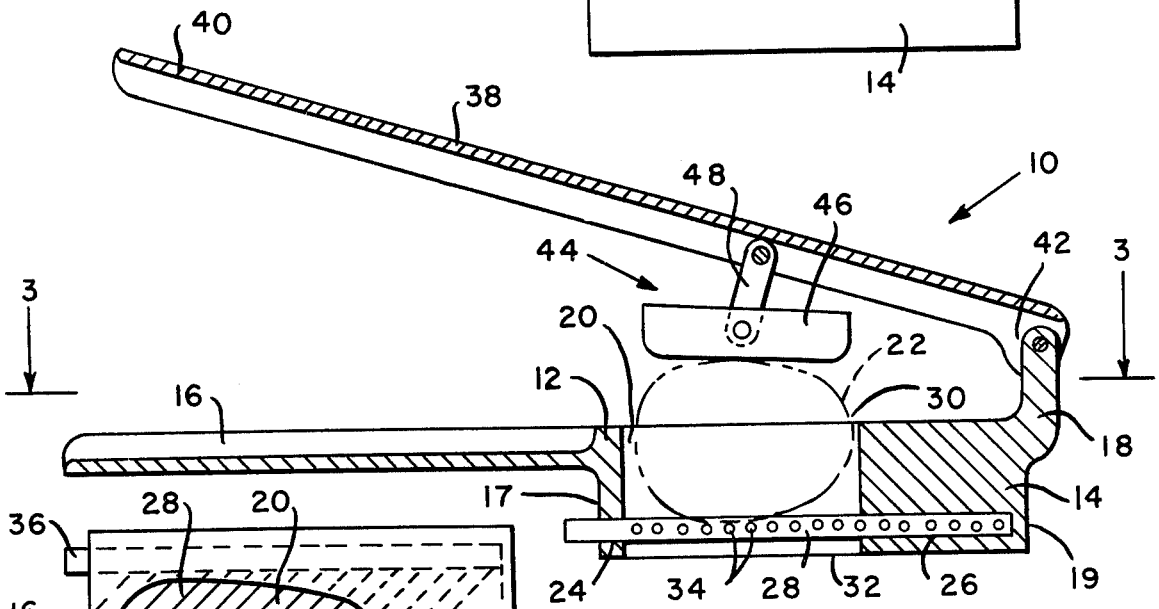
FIG. 2 is a cross-sectional view of the embodiment seen in FIG. 1.

A lateral slot 24 is carried in the side wall 17 of the main body 14 in substantial registration with a blind lateral slot 26 of generally the same dimensions which opens into the channel 20. A cutter means 28 is movably slidable into the main body 14 through respective slots 24 and 26 and lays laterally across channel 20. As seen in FIG. 2 the cutter means 28 is recessed from respectively opposite ends 30 and 32 of the channel 20.

Figure 4:
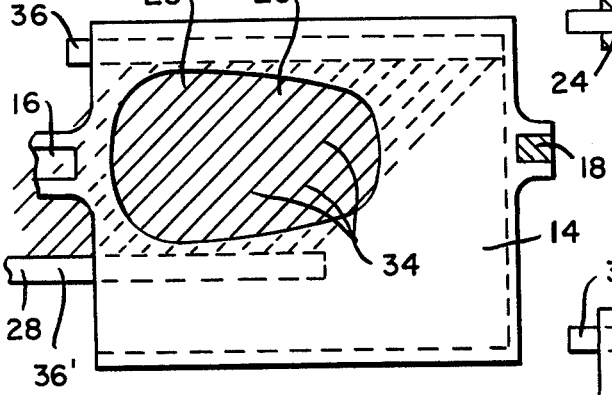
FIG. 4 is a fragmentary plan view of the slicer showing a second position of the cutting means thereof for slicing the egg differently.
Figure 3:
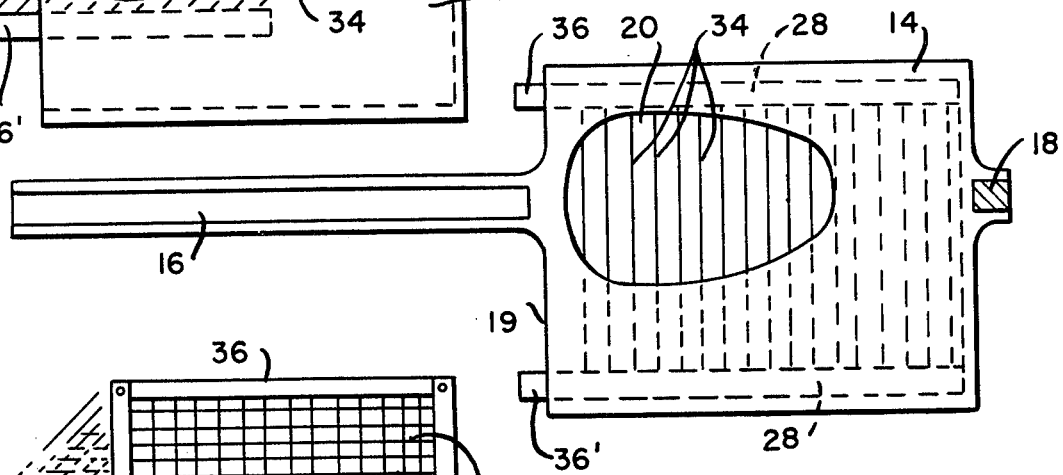
FIG. 3 is a sectional view taken along line 3—3 of FIG. 2.

As seen with reference to FIGS. 3 and 4, the cutter means 28 comprises a plurality of blades 34 in parallel spaced relationship having opposite respective ends thereof movably mounted in corresponding blade holders 36 and 36'. As seen in FIG. 3, the cutter means 28 may be mounted in the main body with the blade holders 36 and 36' in substantially constant alignment. Also, as seen in FIG. 4, the linear placement of one blade holder may be shifted relative to the other to achieve a different cutting orientation. As seen with corresponding reference to FIGS. 3 and 5, the cutting means 28 may include a variety of different blade and holder arrangements.

As best seen in FIGS. 1 and 2, the egg slicer 10 also includes an upper member 38 comprising a linearly elongated handle having a free end 40 and an end 42 pivotally connected to finger 18 of the lower member 12. Connected to upper member 38 in substantial registration with channel 20 is a pusher member 44 comprising a level oval shaped flat rigid member 46 mounted on upper member 38 by strap means 48.

Figure 5:
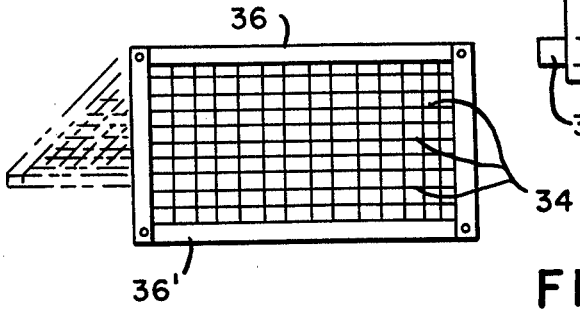
FIG. 5 shows another embodiment of cutter means that may be employed in the egg slicer.

In practice, as best seen in FIG. 2, the egg 22 is placed in channel 20 in the lower member 12 overlying the cutter means 28. As upper member 38 is forced downwardly towards lower member 12, the egg 22 is forced through the cutter means 28 by the pusher member 44. The grid orientation of the cutter means 28 may be changed as heretofore explained by shifting the blade orientation thereof or by providing the cutter means with a different blade system, such as seen in FIG. 5.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. An improved egg slicer comprising a lower member, an upper member pivotally connected to the lower member and a cutter means slideably removably mounted in the lower member, said cutter means including a plurality of elongated blades disposed in spaced apart parallel relationship pivotably secured to at least a pair of elongated bars disposed in spaced apart relationship, one of said pair of said bars being linearly shiftable relative to the other said pair of bars when said cutting means is disposed mounted in said lower member.

2. The egg slicer as claimed in claim 1, the lower member including a main body portion and an elongated handle issuing laterally therefrom.

3. The egg slicer as claimed in claim 2, the lower member including an oval shaped longitudinal channel adapted to receive an egg, said cutter means being mounted across the channel therein.

4. The egg slicer as claimed in claim 3, the upper member comprising an elongated handle having a free end.

5. The egg slicer as claimed in claim 3, including pusher means mounted on the upper member for pushing an egg through the channel and said cutter means disposed mounted in said lower member.

6. The egg slicer as claimed in claim 5, the pusher means comprising a rigid oval shaped member and strap means connecting the rigid oval shaped member to the upper member.

7. The egg slicer as claimed in claim 6, the rigid oval shaped member being registrable in the channel in the lower member when the upper member is pivoted towards the lower member.

* * * * *